United States Patent [19]

Thomas

[11] Patent Number: 4,657,243

[45] Date of Patent: Apr. 14, 1987

[54] FINGER EXERCISE DEVICE

[76] Inventor: Sharon L. Thomas, O N 231 Hathaway, West Chicago, Ill. 60185

[21] Appl. No.: 764,409

[22] Filed: Aug. 12, 1985

[51] Int. Cl.[4] ..... A63B 5/00

[52] U.S. Cl. ..... 272/67; 272/1 R; 446/26

[58] Field of Search ..... 272/1 R, 67, 68, 93; 446/490, 487, 266, 227, 19, 26, 236; 63/2, 29; 434/258, 246; 273/282, 264; 128/25 R, 26; 84/468

[56] References Cited

U.S. PATENT DOCUMENTS

| | | | |
|---|---|---|---|
| 2,877,597 | 3/1959 | Brant | 446/266 |
| 2,992,495 | 7/1961 | Perreira | 434/246 |
| 3,086,315 | 4/1963 | Fasano | 446/266 |
| 3,189,025 | 6/1965 | Yaklin | 128/26 |
| 3,581,408 | 6/1971 | Mohier | 434/258 |
| 4,078,330 | 3/1978 | Roth | 446/26 |
| 4,311,149 | 1/1982 | Panicci | 63/2 X |

FOREIGN PATENT DOCUMENTS

| | | | |
|---|---|---|---|
| 360109 | 8/1921 | Fed. Rep. of Germany | 272/68 |
| 429355 | 5/1926 | Fed. Rep. of Germany | 84/468 |

*Primary Examiner*—Richard J. Apley
*Assistant Examiner*—John L. Welsh

[57] ABSTRACT

A novelty device also useful for hand and finger exercises, including a continuous wire formed with open loops and a captive element riding on the wire. The open loops each fit around a finger so the captive element can be manipulated around the fingers and along the wire by thumb action, finger flexing, and positioning the device for gravity action on the captive element.

5 Claims, 4 Drawing Figures

FIG. 1
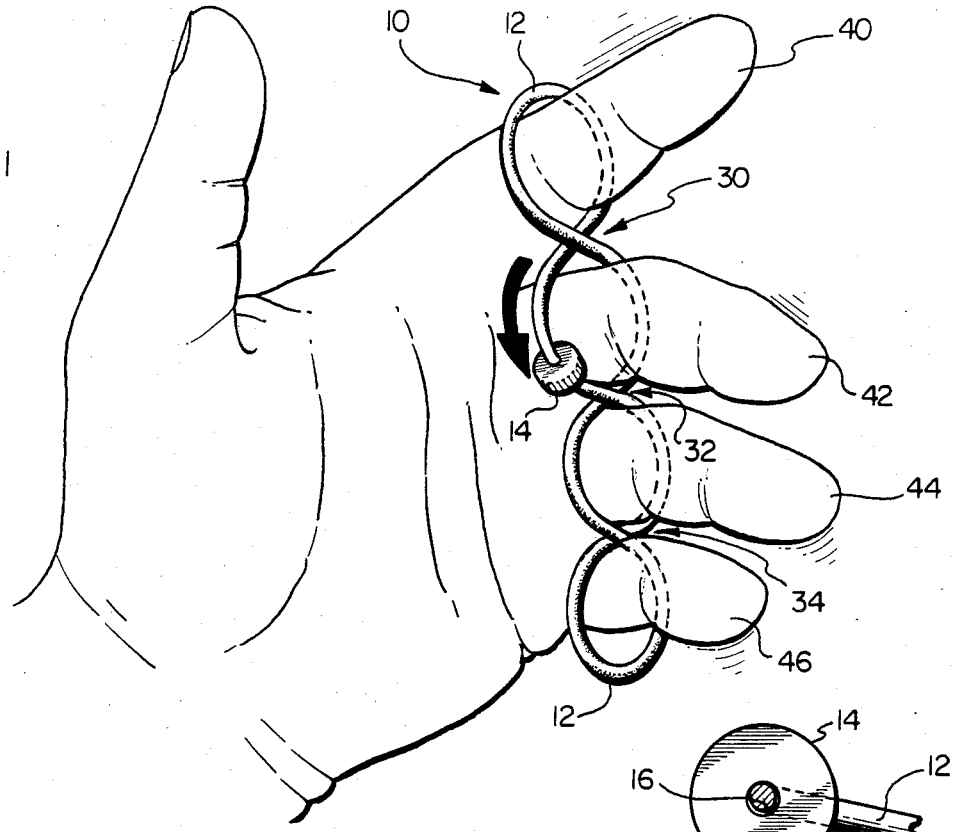
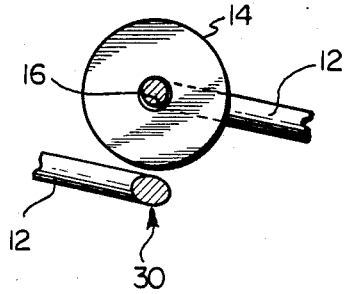
FIG. 4
FIG. 2
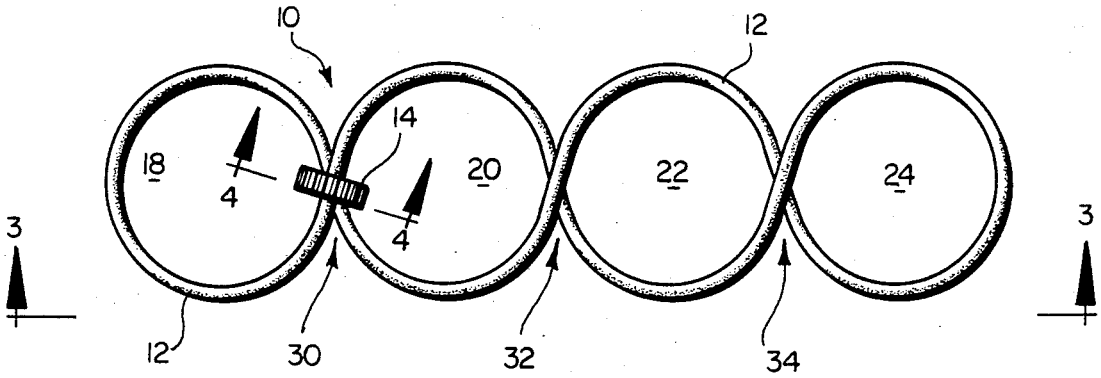
FIG. 3
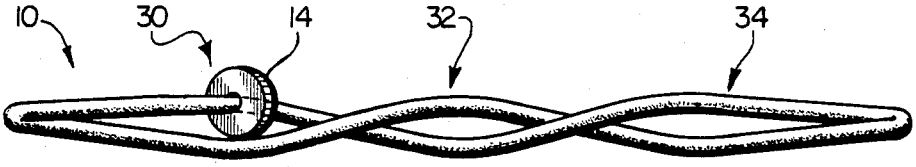

FINGER EXERCISE DEVICE

This invention relates to novelty items and in particular to novelty devices having therapeutic benefits such as for hand and finger exercises.

BACKGROUND OF THE INVENTION

Reference may be made to the following U.S. Pat. Nos. of interest: 3,612,521; 3,581,408; 3,533,185; 3,819,184.

In the aforementioned U.S. Pat. No. 3,612,521, there is described a molded rubber device formed with several closed loops connected together and adapted for placement on a user's hand and with a finger being inserted through each of the closed loops. Physical therapy is provided by the user spreading his hand apart against the resistance of the stretchable rubber device. In U.S. Pat. No. 3,581,408, a manual dexterity measuring and training device is shown which includes a bent metallic rod on which is captured several rings. The user is tested in his ability to move the rings from one end of the bent rod to the other end in as short a time as possible.

It is desired to provide a novelty device which is small and lightweight and can be used by adults as well as children, and which can provide therapeutic benefits as a hand and finger exerciser and as an aid in reducing tension.

SUMMARY OF THE INVENTION

In accordance with the principles of the present invention, there is provided a novelty device which can be mounted on one's fingers and is small and lightweight and easily carried along in a purse or pocket. In particular, the novelty device is formed of a continuous, closed loop extension of a wire-like material with a captive element mounted on the wire-like material so that it can traverse around the closed loop. At least two open loops are formed in the closed loop. Each of the open loops is large enough to permit a finger to be inserted through an open loop. Furthermore, the open loops are sized to enable the captive element to ride along the wire-like material while the device is mounted on one's fingers.

The user attempts to manipulate the captive element by moving the captive element around the closed loop. Thus, the captive element is manipulated from one side of one finger to the other side of the another finger by action of the thumb, fingers, or by gravity provided by the user changing the relative position of the device so that the captive element will be moved or fall by gravity along the closed loop. Therefore, the device can be used as a novelty item, as a toy or game for amusement and as a pastime, and is useful for therapeutic purposes as a finger joint and finger exerciser for persons suffering arthritis, etc.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numberals identify like elements in the several figures and in which:

FIG. 1 is a perspective view illustrating a novelty device formed of a continuous, closed loop extension of wire-like material and formed with several open loops and a captive element mounted for manipulation around the closed loop in accordance with the principles of the present invention;

FIG. 2 is a plan view illustrating the novelty device of FIG. 1;

FIG. 3 is a side elevational view taken along lines 3—3 of FIG. 2 illustrating the continuous closed loop wire-like material formed with four open loops and a captive element riding the loop; and FIG. 4 is a fragmented sectional view taken along section lines 4—4 of FIG. 2 and illustrating the sizing of the open loop.

DETAILED DESCRIPTION

Referring to the drawings, there is illustrated a novelty device 10 having therapeutic benefits such as for finger and hand exercises. Device 10 is formed of a continuous closed, endless loop extension of wire-like material 12 with a captive element such as disc 14. Disc 14 includes an aperture 16 sized slightly larger than wire 12, as illustrated in FIG. 4, so that disc 14 can pass along the wire and traverse the complete, closed loop extension of the wire.

Wire 12 is formed into four open loops 18, 20, 22, 24. The term "open loop" or "open loops" as used herein, means that the loop formed by wire 12 is not connected at least at one end and thus is "open" as shown most clearly in FIGS. 3 and 4. Open loops 18 and 24 are open at one end, whereas open loops 20 and 22 are open at both ends. Accordingly, open loop 18 joins open loop 20 at juncture 30; open loop 20 joins open loop 22 at juncture 32; and open loop 22 joins open loop 24 at juncture 34. At each of the junctures 30, 32, 34, wire 12 crosses but is not joined or connected together. The outer dimensions of disc 14 are sized so that the disc can move through the juncture as it traverses the wire. Thus, the disc can pass from one open loop 18 to another open loop 20 as it traverses along wire 12 and around the continuous closed loop extension of the wire.

Referring now to FIG. 1, it can be seen that each of the open loops is sized to accommodate a finger so that fingers 40, 42, 44, 46 may be inserted through respective open loops 18, 20, 22, 24. As shown in FIG. 1, the user is attempting to manipulate disc 14 which is on open loop 20 on the inside of finger 42 to pass the disc along wire 12 to open loop 22 on the outside of finger 44. In order to do so, the user must spread his fingers apart, use his thumb or twist his hand to reposition the device to allow the disc to more easily fall or be pushed or maneuvered along the wire and around the loop.

As can be seen, device 10 provides amusement and relaxation while also providing therapeutic side-benefits in the exercise of fingers, thumb and hand. In addition, the device is lightweight and small so that it can be easily carried by a person and used in almost any circumstance.

Other alternative embodiments of the invention can be utilized. For instance, wire 12 can be formed of metal or plastic material. Rather than the substantially circular, equal sized open loops 18, 20, 22, 24, oval loops of varying sizes may be formed. In addition, rather than the four loops, one for each finger as illustrated herein, only two or three loops could be used. Alternatively, an open loop for the thumb can also be formed so that the disc can be manipulated around the thumb as well as the fingers.

Captive element 14 may be in the form of the illustrated disc with aperture 16 or could be formed with a closed or open slot riding on wire 12. The element may be rubber, plastic or formed of metal. Also, rather than disc-shaped, it could be round or elongated and hole 16 could be off-center. More than one captive element 14 could be used. Apertures of multiple captive elements could be such that one captive element passes through another.

The foregoing detailed description has been given for clearness of understanding only, and no unnecessary limitations should be understood therefrom, as modifications will be obvious to those skilled in the art.

I claim:

1. A novelty device for placement on a user's fingers and useful for hand and finger exercises comprising:

a one-piece, closed, endless loop formed of a continuous extension of a rigid wire-like material, said endless loop having at least two adjacent open loops and a common juncture between the open loops, with said wire-like material non-connectably crossing at said common juncture;

a captive element slidably mounted on the wire-like material so that the captive element can traverse around and along the two open loops and along the continuous extension of the wire-like material;

each of the open loops being sized with respect to a finger and the captive element and adapted for mounting on a user's fingers so as to accommodate a finger insertable through the respective open loop with the common juncture between fingers and to enable the captive element to be manipulated around the fingers and along the continuous extension of the wire-like material;

whereby upon movement of the user's hand and fingers the captive element will fall by gravity and be maneuvered around and along the closed, endless loop.

2. A novelty device according to claim 1, wherein each of the open loops is substantially circular and substantially equal in size.

3. A novelty device according to claim 1, wherein said captive element includes an aperture slightly larger than the wire-like material, with the wire-like material passing through the aperture.

4. A novelty device according to claim 3, including an open loop formed for each finger.

5. A novelty device according to claim 4, wherein each of the open loops is substantially circular and substantially equal in size.

* * * * *